United States Patent [19]

Essler et al.

[11] 4,310,818

[45] Jan. 12, 1982

[54] ELECTROMAGNETIC RELAY WITH IMPROVED FIXED CONTACT ELEMENTS

[75] Inventors: Richard Essler, Munich; Helmut Schedele, Hoegling, both of Fed. Rep. of Germany

[73] Assignee: Siemens Aktiengesellschaft, Berlin & Munich, Fed. Rep. of Germany

[21] Appl. No.: 115,901

[22] Filed: Jan. 28, 1980

[30] Foreign Application Priority Data

Mar. 30, 1979 [DE] Fed. Rep. of Germany ... 7909179[U]

[51] Int. Cl.[3] ..... H01H 50/14

[52] U.S. Cl. ..... 335/135; 200/283; 200/246

[58] Field of Search ..... 335/135, 128, 133; 200/245, 246, 247, 283, 284, 285

[56] References Cited

U.S. PATENT DOCUMENTS 3,842,231 10/1974 Schedele et al. ..... 200/283

4,027,131 5/1977 Aidn et al. ..... 335/135

*Primary Examiner*—Harold Broome

*Attorney, Agent, or Firm*—Hill, Van Santen, Steadman, Chiara & Simpson

[57] ABSTRACT

A relay having a housing and a base has a number of flexible contact elements mounted in slots in the base, each having a fixed terminal extending out of the relay and a contact portion extending inside the relay movable by an electromagnetic actuator. Each contact element has a longitudinal slot therein for receiving a transverse rib carried on the relay base for rigidly retaining the contact element in place and minimizing transmittal of mechanical displacement forces from the terminal portion of the element to the contact portion thereof. Each contact element may also be provided with a retaining tooth which engages a cooperatively disposed slot in the relay base to add further stability to the contact element mounting. Each contact element may thus be provided with a greater flexible portion thereof having unimpaired movement without increasing the size of the relay housing.

6 Claims, 5 Drawing Figures

ELECTROMAGNETIC RELAY WITH IMPROVED FIXED CONTACT ELEMENTS

BACKGROUND OF THE INVENTION

1. Field of the Invention

The present invention relates to electromagnetic relays, and in particular to a mounting for electrical contacts in such relays which minimizes transfer of mechanical displacement forces from the relay terminals to the electrical contacts while maximizing spring flexibility of the contacts.

2. Prior Art

Electromagnetic relays using flexible leaf-spring contact elements which are movable by an electromagnetic actuator are known in the art. Such contacts are mounted or potted in a base of the relay so as to fix the positions of the contacts with terminal portions extending outwardly from the relay for external electrical connection by soldering or any suitable means. This type of relay construction is preferable to the previously utilized layering contact assembly arrangement in that the present construction makes use of a single base body which is molded with the longitudinal slots for receiving the contact elements generated during the molding process. The individual contact elements are then inserted into the slots which may be easily accomplished with automated devices.

A problem in the art arising out of this type of relay construction is that of anchoring the individual contact elements solidly in the base while at the same time allowing a sufficient freely movable length of spring contact. The competing design goals are that of preventing transmission of mechanical forces from the exterior to the interior portions of the contacts, which requires rigid anchoring, and that of improving the efficiency of the relay by providing sufficient spring contact length to make the contacts easily movable by the electromagnetic actuator. The first goal requires a stiff spring, while the second goal requires a more flexible leaf spring. A further problem is that of providing a relay with the smallest possible total volume, which places limitations on the contact length which may be utilized.

SUMMARY OF THE INVENTION

It is an object of the present invention to provide an electromagnetic relay of a small total volume in which the electrical contact elements are firmly fixed in a base thereof with terminals extending out of the relay, and in which the interior portion of the electric contact elements has a maximum flexible length.

This object is achieved by providing a lateral rib associated with each electrical contact element in the vicinity of the slot in the relay base in which a respective contact element is received. Each contact element has a correspondingly shaped lateral slot therein for cooperative engagement with the rib to prevent vertical movement of the contact. The rib further adds strength to the relay base to prevent splitting and cracking of the slot in which the contact is received.

Each contact element may be further provided with a tooth extending outwardly into a groove in the relay base disposed immediately beneath the rib. The combination of the lateral rib and the outwardly extending tooth provide enhanced resistance to transmittal of displacement forces from the exterior to the interior portions of the contact.

As a further feature to prevent vertical movement of the contacts, each contact is provided with a fastening tab which may be twisted or otherwise slightly forced into an opening in the relay base. The tab extends generally perpendicularly to the length of the contact element so that not only does the tab prevent vertical movement of the contact element, but also prevents lateral movement and firmly holds the contact element in place.

In order to insure sufficient flexibility of any of the contacts which are to be moved by the electromagnetic actuator, the movable contact element may be comprised of two joined portions, having differing spring constants. The portion which is to form the lower part of the contact, and extend outwardly of the relay as a terminal, is comprised of a relatively stiff electrically conducting material, while the movable portion, extending into the interior of the relay, is comprised of a more flexible electrically conducting material. The portions are joined in a central region and affixed in the relay base in the manner described above. The relay base is provided with an angled portion to allow increased freedom of movement of the flexible contact element portion.

DESCRIPTION OF THE PREFERRED EMBODIMENTS

Figure 2:
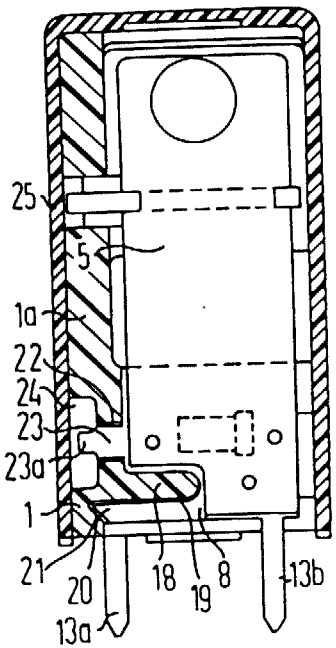
FIG. 2 is a sectional view taken along line II—II of FIG. 1.
Figure 1:
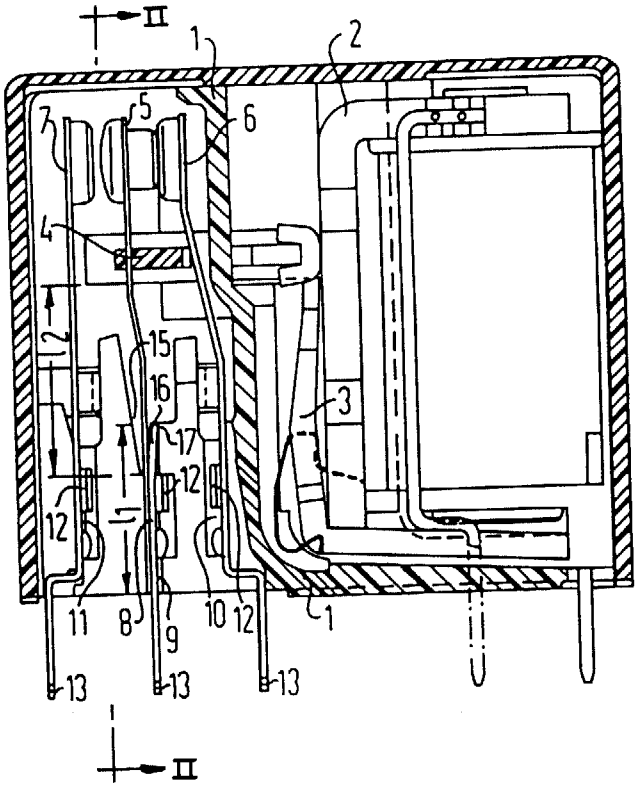
FIG. 1 is a sectional view of an electromagnetic relay constructed in accordance with the principles of the present invention.

An electromagnetic relay constructed in accordance with the principles of the present invention is shown in section in FIGS. 1 and 2. The relay has a base portion 1 covered by a protective cap 25. The base 1 and the cap 25 may be formed of molded plastic or any other suitable material. The relay has a conventional electromagnetic device 2 which operates a linkage 3 to move a slide actuator 4. In the embodiment shown, three contact elements 5, 6 and 7 are provided. Electrical connections are made and broken by movement of the central contact element 5 between the contacts 6 and 7 which remain stationary.

The stationary contacts 6 and 7 respectively extend downwardly into slots 10 and 11 and terminate in terminals 13 outside of the relay. The contacts 6 and 7 are anchored directly in the relay base 1 as will be more fully described below. The central flexible contact 5 extends to a bottom of the relay where it terminates. The external terminal 13 for the central contact 5 is formed from a supporting carrier 8 which is joined to the flexible contact 5 in an electrically conducting manner. The contact 5 and the support 8 are received in a groove 9 in the relay base 1.

As shown in FIG. 2, depending upon the particular application of the relay, the contact elements 5, 6 and 7 may be provided with two terminals 13*a* and 13*b* insertable in separate receptacles or connectable to different leads.

Figure 3:
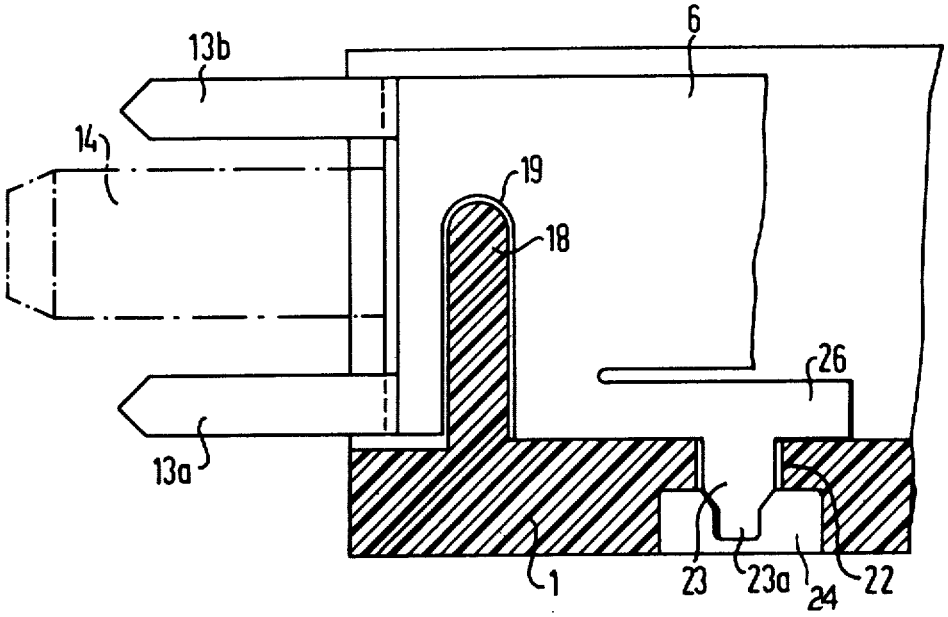
FIG. 3 is an enlarged portion of FIG. 2 showing the contact mounting in detail.

In a further embodiment, as shown in the dashed line in FIG. 3, flat plug pins 14 may be utilized in place of the terminals 13.

Anchoring of the contacts is achieved as follows. The stationary contacts 6 and 7, and the support carrier 8 for the flexible contact 5 each have lateral tabs thereon which abut an upper wall of the respective slots 9, 10 and 11, thus limiting vertical movement. In order to further anchor the contacts, as shown in FIG. 2, a lateral rib 18 is formed on the relay base 1 which is received in a correspondingly shaped groove 19 in the support carrier 8. An identical rib and groove arrangement is utilized with the stationary contacts 6 and 7. Further, the support carrier 8 possesses a laterally extending tooth 20 which extends into a groove 21 in the relay base 1. Finally, in a rear portion 1*a* of the base 1 there is provided a receptacle 22 for receiving a second laterally extending tab 23. The second tab 23 is twisted at an end 23*a* thereof, or otherwise lightly forced, into an indented grommet 24. Rigid anchoring with acceptable mechanical strength of the contact is best achieved when the rib 18 and groove 19 comprise approximately one-half of the contact width.

As shown in FIG. 1, lateral movement of the flexible portion of the central contact 5 is increased by beveling a sloping portion 15 of the relay base 1 in the vicinity of the tab 12. The supporting carrier 8 is similarly bent at 16 to abut a portion 17 of the base 1 to provide a "feathering" effect. This results in a division of the length of the contact element 5 into overlapping portions $1_1$ and $1_2$ with portion $1_1$ being securely anchored in the relay base 1 while portion $1_2$ is free to flex in response to movement of the slide actuator 4.

Anchoring of the fixed contacts 6 and 7 is shown in FIG. 3 which utilizes the rib and groove arrangement 18 and 19 as well as the twisted tab 23. As shown in FIG. 3, the contact 6, as well as the contact 7, may have a vertical cut therein to separate the contact into a leg 23 which remains in a fixed position and thereby anchors the contact while allowing some degree of flexibility for the remaining portion of the contact.

Figure 4:
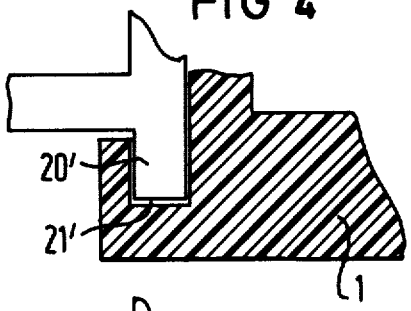
FIG. 4 is an enlarged portion of FIG. 2 showing an alternate embodiment of the outwardly extending contact tooth.
Figure 5:
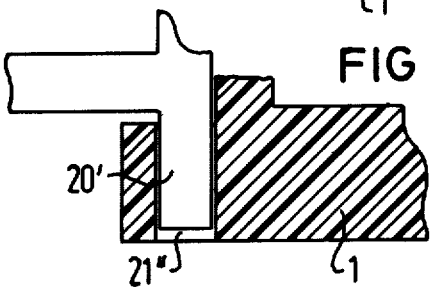
FIG. 5 is an enlarged portion of FIG. 2 showing another alternate embodiment of the outwardly extending contact tooth.

Alternate embodiments of the tooth 20 and the groove 21 are shown respectively in FIGS. 4 and 5. In the embodiment of FIG. 4, a square-cornered tooth 20' is utilized which is received in correspondingly shaped receptacle 21'. In the embodiment of FIG. 5, the square-cornered tooth 20' is utilized with a bore 21'' which extends completely through the relay base 1 and does not require the use of a grommet such as 24. The tooth 20' is not of sufficient length to extend through the bore 21'' to interfere with affixing the protective cap 25 over the internal components of the relay.

Although modifications and changes may be suggested by those skilled in the art, it is the intention of the inventors to embody within the patent warranted hereon all changes and modifications as reasonably and properly come within the scope of their contribution to the art.

We claim as our invention:

1. A relay comprising:

a base having a plurality of parallel slots therein;

a plurality of leaf-spring contact elements each extending through one of said base slots and at least one of said contact elements having a longitudinal slot therein;

an electromagnetic actuator means for moving at least one of said contact elements in response to a signal received by said actuator means;

a longitudinally extending tab carried on at least one of said contact elements, said relay base having at least one receptacle in registry with said tab when said contact element carrying said tab is anchored in said base, said receptacle having a grommet therein for twistingly receiving said tab for retaining said tab therein;

at least one of said contact elements having a lengthwise slot therein perpendicular to said longitudinal slot dividing said contact element into parallel legs, one of said legs carrying said longitudinally extending tab thereon and being anchored to said base, and the other of said legs being movable; and at least one longitudinal rib carried on said base, said rib being received in the longitudinal slot in one of said contact element for anchoring said one contact element in said base.

2. The relay of claim 1 wherein said longitudinal slot in each contact element extends into the contact element a distance equal to approximately one half of the width of the contact element.

3. The relay of claim 1 wherein at least one contact element has a longitudinally extending tooth carried thereon and wherein said base has a corresponding groove therein for receiving said tooth to further anchor said contact element in said base.

4. The relay of claim 3 wherein said tooth is disposed immediately beneath said longitudinal slot in said contact element.

5. The relay of claim 1 wherein at least one of said slots in said base has upper beveled edges to widen a portion of said slot to permit increased contact element movement above said slot.

6. A relay comprising:

a base having a plurality of parallel slots therein;

a plurality of leaf-spring contact elements each extending through one of said base slots and at least one of said contact elements having a longitudinal slot therein;

an electromagnetic actuator means for moving at least one of said contact elements in response to a signal received by said actuator means;

at least one longitudinal rib carried on said base, said rib being received in the longitudinal slot in one of said contact elements for anchoring said one contact element is said base; and at least one of said contact elements being comprised of a flexible member and a rigid member, said flexible and rigid members being joined in an electrically conducting manner, said rigid member extending out of said relay and forming an externally accessible terminal, and said flexible member extending into said relay and disposed therein for movement by said electromagnetic actuator.

* * * * *